US006415457B2

(12) United States Patent
Schmucki

(10) Patent No.: US 6,415,457 B2
(45) Date of Patent: Jul. 9, 2002

(54) FLUSHING DEVICE FOR TOILET SYSTEM

(75) Inventor: Peter Schmucki, Eschenbach (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 09/575,588

(22) Filed: May 22, 2000

(30) Foreign Application Priority Data

Feb. 8, 2000 (CH) ..... 251/00

(51) Int. Cl.[7] ..... E03D 11/00
(52) U.S. Cl. ..... 4/420; 4/421; 4/425; 4/428
(58) Field of Search ..... 4/420, 421, 425, 4/428

(56) References Cited

U.S. PATENT DOCUMENTS

| | | | | | |
|---|---|---|---|---|---|
| 1,067,095 | A | * | 7/1913 | Cochran | 4/425 |
| 1,116,323 | A | * | 11/1914 | Payne | 4/425 |
| 1,966,786 | A | * | 7/1934 | Brain | |
| 2,066,881 | A | * | 1/1937 | Groeniger | 4/425 |
| 4,145,776 | A | * | 3/1979 | Crosby et al. | 4/425 |
| 5,054,133 | A | * | 10/1991 | Pickerrell et al. | 4/425 |
| 5,218,726 | A | * | 6/1993 | Jaeckels et al. | 4/420 |
| 5,283,913 | A | * | 2/1994 | Jaeckels | 4/420 |
| 5,651,148 | A | * | 7/1997 | Bayot | 4/421 |
| 5,926,863 | A | * | 7/1999 | Arita et al. | 4/425 |

FOREIGN PATENT DOCUMENTS

| | | | | |
|---|---|---|---|---|
| DE | 92 16 494 | | 1/1993 | |
| EP | 0 407 609 B1 | | 1/1990 | |
| EP | 0407609 | * | 1/1991 | |
| GB | 471314 | | 9/1937 | |
| GB | 504872 | | 5/1939 | |
| GB | 685960 | | 1/1953 | |
| JP | 6185102 | * | 7/1994 | 4/421 |

OTHER PUBLICATIONS

English translation of EP 9216494.*

* cited by examiner

*Primary Examiner*—Gregory L. Huson
*Assistant Examiner*—Khoa Huynh
(74) *Attorney, Agent, or Firm*—Collen IP; Robert M. McDermott

(57) ABSTRACT

The flushing device comprises a flush bowl (1) comprising an odor trap (8) on a bottom part (7) and comprises a flushing conduit (2) with flushing openings (14, 15, 16) on an upper edge (3). Flushing openings (14) in a frontal area (13) of the flushing conduit (2) have a greater throughput than laterally arranged flushing openings (15, 16) do. The flushing openings (4) in said frontal area (13) are arranged in an asymmetric manner and the flushing water (17) forms a flushing vortex (17*c*) in the bowl (11). The flushing device makes it possible to effectively flush with less flushing water.

21 Claims, 2 Drawing Sheets

FLUSHING DEVICE FOR TOILET SYSTEM

BACKGROUND OF THE INVENTION

1. Field of the Invention

The invention is relative to a flushing device for a toilet system with a bowl comprising an odor trap on a bottom part and comprising a flushing conduit with flushing openings on an upper edge through which openings flushing water can be introduced for flushing the bowl. The flushing openings have a greater flowthrough in a frontal area of the flushing conduit than laterally arranged flushing openings do.

2. Description of Related Art

Flushing devices of this type are generally known and very widespread. For reasons of economy and ecology there is great interest in being able to reduce the consumption of water for the flushing of such flush bowls by improving the action of flushing. Hygienic requirements should be able to be met even in the case of minimal consumption of flushing water.

In the flushing device according to EP 0,407,609 B the water flowing into the bowl is conducted into a V-shaped recess in the bottom part of the bowl. This recess is constricted [narrowed] in horizontal section in a vertical direction towards the bottom of the bowl.

The two Swiss patent applications 99/0827 and 99/1378 of the applicant teach flushing devices in which an improved suction action can be achieved by means of a runoff [discharge] pipe. These runoff pipes are constricted in a vertical area. This constriction achieves a suction action which brings about an improved flushing of the flush bowl. These two patent applications are cited as part of the disclosure.

BRIEF SUMMARY OF THE INVENTION

The invention has the problem of creating a flushing device of the cited type which makes possible a reliable and hygienic flushing with a lesser amount of flushing water. The problem is solved in accordance with claim 1 in that the flushing openings are asymmetrically arranged in said frontal area of the flushing conduit and that the flushing water forms a flushing vortex in the bowl. As a result of the asymmetric formation of the inlet of the flushing water the flushing water receives a spin [twist] in the bowl and especially in the lower area of the bowl and screws itself, so to say, into the odor trap. A more efficient flushing action is achieved in comparison to a symmetric inlet, e.g., according to EP 0,407,609 B cited above. In particular, solid matter is carried along very effectively by the flushing vortex, transported into the odor trap and subsequently into the runoff pipe. It also turned out that as a result of said flushing vortex the runoff pipe is filled more rapidly with flushing water than previously. This is especially advantageous in the context of the two patent applications cited above and of the flushing devices disclosed in them.

An especially effective thrusting force of the flushing water is achieved in accordance with a further development of the invention in that said frontal area of the flushing water inlet comprises several flushing jets with a significantly larger throughput than other, laterally arranged flushing jets. The flushing water flows with a comparatively narrow but strong flushing current from said frontal bowl area into the runoff opening. At the same time, this flushing current receives a spin and forms, as mentioned, a flushing vortex. An asymmetric arrangement of the flushing water inlet is achieved in accordance with a further development of the invention by an eccentric arrangement of another flushing jet. The incoming flushing water runs obliquely in the bowl to a mirror plane of the bowl and preferably penetrates this mirror plane completely.

Further advantageous features result from the dependent claims, the following description and the drawings.

BRIEF DESCRIPTION OF THE DRAWINGS

An exemplary embodiment of the invention is explained in detail in the following with reference made to the drawings.

DETAILED DESCRIPTION OF THE INVENTION

Figure 1:
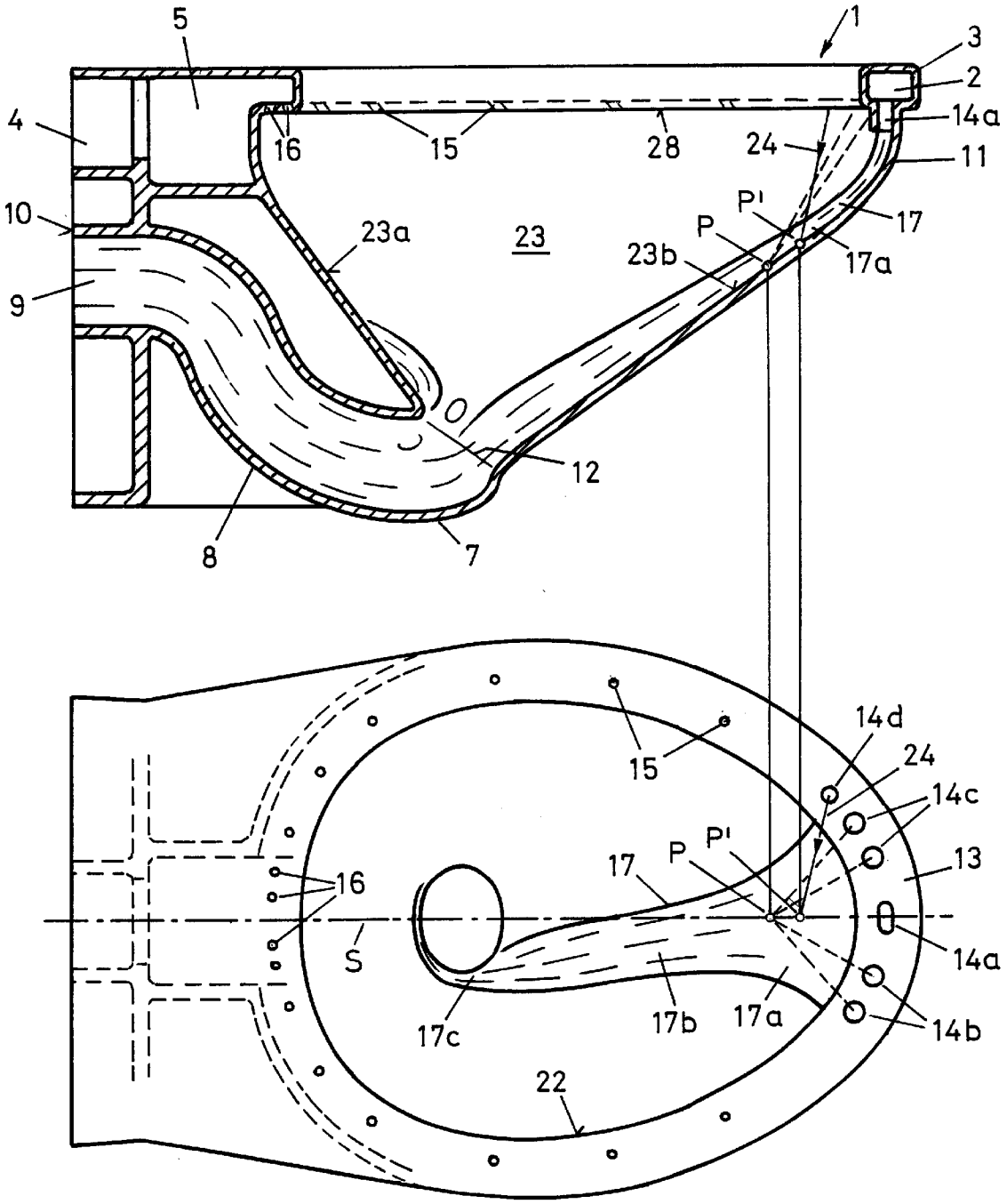
FIG. 1 shows a flush bowl in vertical section and in a top view.

Flushing device 1 shown in FIG. 1 comprises circumferential upper edge 3 that forms an approximately egg-shaped opening 22 and functions in a known manner as a support for a toilet cover (not shown here). Circumferential flushing conduit 2 is arranged in edge 3 and forms widened-out space 5 in a rear area. Conduit 2 is to be connected in the area of space 5 via opening 4 to a toilet flush tank (not shown here). Flush bowl 1 is fastened on back side 10 to a building wall or a frame (not shown here).

Conduit 2 comprises several openings 14, 15 and 16 on bottom 28 of edge 3 which openings form a flushing water inlet. The water flowing into space 5 through opening 4 is distributed in the conduit and passes through said openings 14, 15 and 16 down along inner side 23 and through a somewhat constricted passage 12 into odor trap 8 arranged in bottom 7 of flush bowl 1. This odor trap 8, also called a siphon, leads to exit 9 on back side 10. Discharge pipe 18 is connected to this exit 9 in accordance with FIGS. 2, 3.

As FIG. 1 in particular clearly shows, openings 14 in frontal area 13 of edge 3 are significantly larger than lateral openings 15 and openings 16 arranged on the back side. Openings 14 have a significantly larger flowthrough section than the other openings 15, 16. The flowthrough section of openings 14 is a multiple larger than that of openings 15, 16. Thus, by far the greatest amount of the flushing water flows through openings 14.

As is apparent, openings 14*a* are formed by central main opening 14 as well as laterally arranged openings 14*b*, 14*c* and 14*d*. Preferably, opening 14*a* is centrally arranged, and oblong in shape. Openings 14*b* and 14*c* are arranged symmetrically to main opening 14*a* and have the same flowthrough section. Somewhat smaller opening 14*d* is present only once, as is apparent, and is somewhat smaller than openings 14*c*. Thus, on the whole openings 14 are asymmetrically designed in such a manner that a flow component is produced through opening 14*d* in the direction of arrow 24 which imparts a direction to incoming flushing water 17 which direction runs obliquely relative to mirror plane S. Thus, flushing water 17 does not flow centrally and symmetrically through mirror plane S into passage 12 but rather with a spin which runs clockwise in FIG. 1. According to FIG. 1, flushing water 17 is approximately funnel-shaped in upper area 17*a*, essentially laminar in middle area 17*b* and helical in lower area 17*c*.

Openings 14 form downwardly directed jets, as can be seen in FIG. 1. The directions of flow are indicated in FIG. 1 with dotted lines. Point P shows the point onto which openings 14*a*, 14*b* and 14*c* and the corresponding jets are focused. Point P is located on inside 23*b* of the bowl and in mirror plane S. Opening 14*d* is not focused on point P but rather is directed onto point P' located slightly above point P. This imparts a spin, as mentioned, to the flow of flushing water 17.

Figure 2:
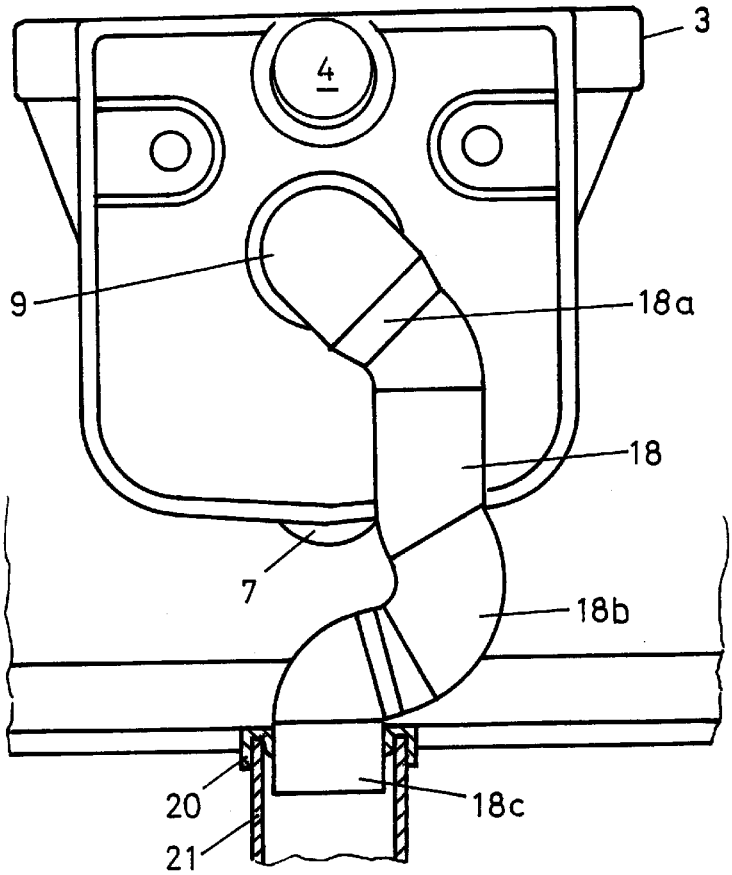
FIG. 2 shows a view of the back side of the flushing device in accordance with the invention.
Figure 3:
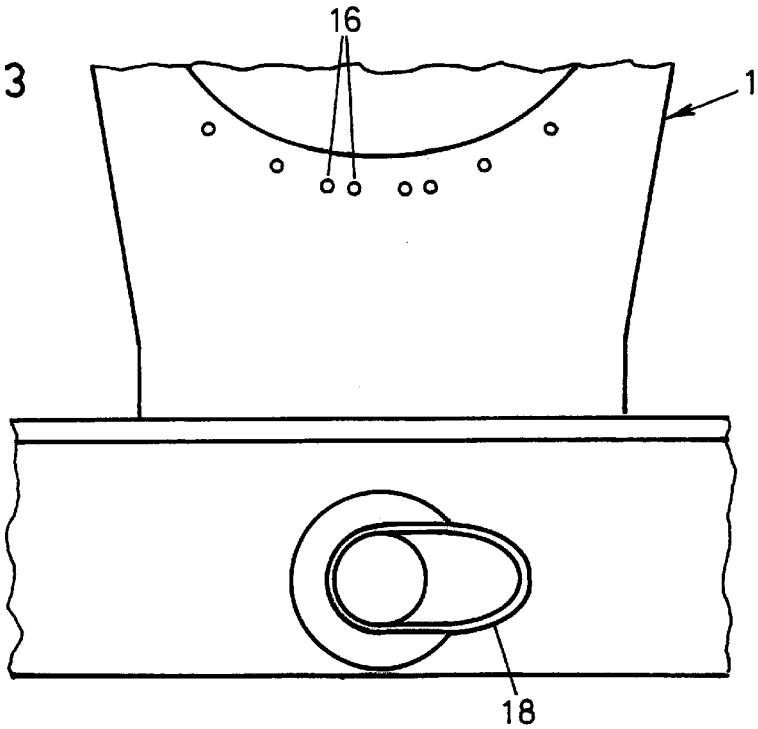
FIG. 3 shows a partial view of the flushing device of FIG. 2.

Flushing water 17 flows as mentioned above helically into odor trap 8 and from the latter into runoff pipe 18 shown in FIGS. 2 and 3. Constriction 18*a* brings it about that runoff pipe 18 is filled with flushing water and a closed flow is formed. As a result, a suction action is produced in runoff pipe 18 and flushing water 17 passes via bend [elbow] 18*b* to connecting piece 18*c* and finally into removal line 21 which is sealed onto connecting piece 18*c* by rubber seal 20. This suction action results in a very rapid emptying of flush bowl 11. The flushing water is accelerated by the suction action, which causes solid matter to be entrained and flushed away. Thus, the asymmetric introduction of the flushing water mentioned above reinforces the action of runoff pipe 18 and in particular the suction action by virtue of the particular shape of runoff pipe 18.

What is claim is:

1. A flushing device for a toilet system with a flush bowl comprising:

an odor trap on a bottom part and a substantially unconstricted flushing conduit with flushing openings on an upper edge through which flushing openings, flushing water can be introduced for flushing the bowl, characterized in that three or more of the flushing openings in a frontal area of the flushing conduit are directed such that flow from each of these three or more flushing openings is directed substantially toward a first point, at least one other of the flushing openings is directed to a second point that differs from the first point, thereby forming a flushing vortex in the bowl, and the flow from at least one of the three or more of the flushing openings is in a direction that opposes the flushing vortex.

2. The flushing device according to claim 1, characterized in that the flushing openings comprise several directed flushing jets.

3. The flushing device according to claim 2, characterized in that the flushing openings in the frontal area comprise several flushing jets which have a significantly larger throughput than other, laterally arranged flushing jets.

4. The flushing device according to claim 3, characterized in that a runoff pipe is connected to the flush bowl at a rear exit and that this runoff pipe includes a vertical segment having a reduced diameter, and is of sufficient length in the vertical direction to provide a suction action.

5. The flushing device according to claim 3, characterized in that the flushing openings in the frontal area is designed in such a manner that a flow is formed which flows essentially completely through a mirror plane in a central area of the bowl.

6. The flushing device according to claim 5, characterized in that a runoff pipe is connected to the flush bowl at a rear exit and that this runoff pipe includes a vertical segment having a reduced diameter, and is of sufficient length in the vertical direction to provide a suction action.

7. The flushing device according to claim 2, characterized in that the frontal area comprises a main flushing jet which has a significantly larger throughput than the other flushing jets in the frontal area.

8. The flushing device according to claim 7, characterized in that the main flushing jet is essentially centrally arranged and designed as an oblong hole.

9. The flushing device according to claim 8, characterized in that the main flushing jet is located in a mirror plane of the bowl.

10. The flushing device according to claim 9, characterized in that the flushing openings in the frontal area are designed in such a manner that a flow is formed which flows essentially completely through the mirror plane in a central area of the bowl.

11. The flushing device according to claim 10, characterized in that the flow of the flushing water on the bottom of the bowl and in particular in a passage to the odor trap runs with a helical spin.

12. The flushing device according to claim 11, characterized in that a runoff pipe is connected to the flush bowl at a rear exit and that this runoff pipe includes a vertical segment having a reduced diameter, and is of sufficient length in the vertical direction to provide a suction action.

13. The flushing device according to claim 7, characterized in that the other flushing jets are arranged to the left and the right of and adjacent to the main flushing jet.

14. The flushing device according to claim 13, characterized in that at least one other eccentrically arranged flushing jet is provided in the frontal area.

15. The flushing device according to claim 1, characterized in that the flushing openings in the frontal area are designed in such a manner that a flow is formed which flows essentially completely through a mirror plane in a central area of the bowl.

16. The flushing device according to claim 15, characterized in that the flow of the flushing water on the bottom of the bowl and in particular in a passage to the odor trap runs with a helical spin.

17. The flushing device according to claim 1, characterized in that a runoff pipe is connected to the flush bowl at a rear exit and that this runoff pipe includes a vertical segment having a reduced diameter, and is of sufficient length in the vertical direction to provide a suction action.

18. A flushing device far a toilet system with a flush bowl comprising:

an odor trap on a bottom part and a flushing conduit with flushing openings on an upper edge through which flushing openings, flushing water can be introduced for flushing the bowl which flushing openings have a greater flowthrough in a frontal area of the flushing conduit than laterally arranged flushing openings do, characterized in that three or more of the flushing openings in the frontal area are directed such that flow from these openings is substantially toward a first point, at least one other of the flushing openings is directed to a second point that differs from the first point, thereby forming a flushing vortex in the bowl, and the flow from at least one of the three or more of the flushing openings is in a direction that opposes the flushing vortex.

19. The flushing device of claim 19 wherein the three or more of the flushing openings that are directed toward the first point are symmetrically arranged in the frontal area of the flushing conduit.

20. The flushing device of claim 18, wherein the at least one other of the flushing openings is designed in such a manner that the flushing water flows essentially completely through a mirror plane in a central area of the bowl.

21. The flushing device according to claim 18, wherein a runoff pipe is connected to the flush bowl at a rear exit and that this runoff pipe includes a vertical segment having a reduced diameter, and is of sufficient length in the vertical direction to provide a suction action.

* * * * *